United States Patent [19]

Rotella

[11] 4,341,371

[45] Jul. 27, 1982

[54] CAR RAMP AND SUPPORTING DEVICE

[76] Inventor: Thomas B. Rotella, 22 E. 7th St., Clifton, N.J. 07011

[21] Appl. No.: 216,772

[22] Filed: Dec. 15, 1980

[51] Int. Cl.[3] ..... E02C 3/00

[52] U.S. Cl. ..... 254/88; 24/69.5

[58] Field of Search ..... 254/88, 1; 188/32, 36; 248/352; 14/69.5

[56] References Cited

U.S. PATENT DOCUMENTS 3,870,277 3/1975 West ..... 254/88

FOREIGN PATENT DOCUMENTS 1384379 2/1975 United Kingdom ..... 254/88

*Primary Examiner*—Robert C. Watson

*Attorney, Agent, or Firm*—W. Patrick Quast

[57] ABSTRACT

There is disclosed an improved vehicle ramp and supporting device wherein said device utilizes a standard cinder or concrete construction block. The device includes a framework which comprises first and second brackets which are disposed along the longitudinal axis of the construction block and which are configured so as to conform to the contour of the top surface of the block. These brackets include tabs on each end which restrain the movement thereof in the direction of the longitudinal axis of the block. First and second tie brackets are also disclosed. These cooperate with corresponding ends of the first and second brackets and with the sides of the construction block to restrain the movement of the first and second brackets relative to the block in a direction perpendicular to its longitudinal axis. A ramp is disclosed which is removably connected to one end of the framework disposed on the block, providing the means for raising the vehicle from the level of the work surface to the top surface of the block.

3 Claims, 2 Drawing Figures

CAR RAMP AND SUPPORTING DEVICE

FIELD OF THE INVENTION

This invention relates to vehicle ramp and supporting devices and, more particularly, to a readily assembled or disassembled frame and ramp to be used in conjunction with a standard construction concrete or cinder block.

BACKGROUND OF THE INVENTION

Vehicle ramp and supporting devices are not new. Generally, the units on the market today are of unitary construction, made from heavy duty steel. This insures sturdiness while the vehicle is being worked on but results in a cumbersome storage problem, particularly for the average, do-it-yourself homeowner.

Attempts have been made to provide more readily storable devices. These have included a detachable ramp from the wheel supporting member which is thereafter stored within the supporting member to form a more compact unit. Others, have provided for collapsible units which reduce down to a relatively compact size for storage. These, generally, require relatively complex interconnections of the various parts increasing the cost and thus the undesirability of such devices for the general public.

There is disclosed herein, a relatively inexpensive frame/ramp unit which, when used in conjunction with a standard construction cinder or concrete block, provides a comparably sturdy and safe device such as those described above.

The invention disclosed describes a unit which can be constructed from readily available materials, such as angle brackets, steel plates and other standard material.

With minor modifications to the basic design, the frame/ramp unit can be used with differing sized construction blocks.

It is, therefore, a primary object of this invention to provide an inexpensive, but sturdy and safe, ramp-supporting device which can be assembled or disassembled and stored in a relatively small area.

It is yet another object of this invention to provide a device which is readily portable and stored, even in the owner's vehicle, so as to enhance its usefulness, such as on trips.

SUMMARY OF THE INVENTION

Toward the accomplishment of these and other objects and advantages, which will become apparent from the consideration of the drawings and description hereinafter, there is disclosed an improved vehicle ramp and supporting device wherein said device utilizes a standard cinder or concrete construction block. The device includes a framework which comprises first and second brackets which are disposed along the longitudinal axis of the construction block and which are configured so as to conform to the contour of the top surface of the block. These brackets include tabs on each end which restrain the movement thereof in the direction of the longitudinal axis of the block. First and second tie brackets are also disclosed. These cooperate with corresponding ends of the first and second brackets and with the sides of the construction block to restrain the movement of the first and second brackets relative to the block in a direction perpendicular to its longitudinal axis. A ramp is disclosed which is removably connected to one end of the framework disposed on the block, providing the means for raising the vehicle from the level of the work surface to the top surface of the block.

Further, one of the tie brackets can be configured to act as a chock which prevents the vehicle's wheels from going off that end of the block.

Also, the invention utilizes standard metal shapes, such as angle brackets, and a steel plate to form the framework, thus providing an economical device for the do-it-yourselfer.

DESCRIPTION OF THE PREFERRED EMBODIMENT

Figure 1:
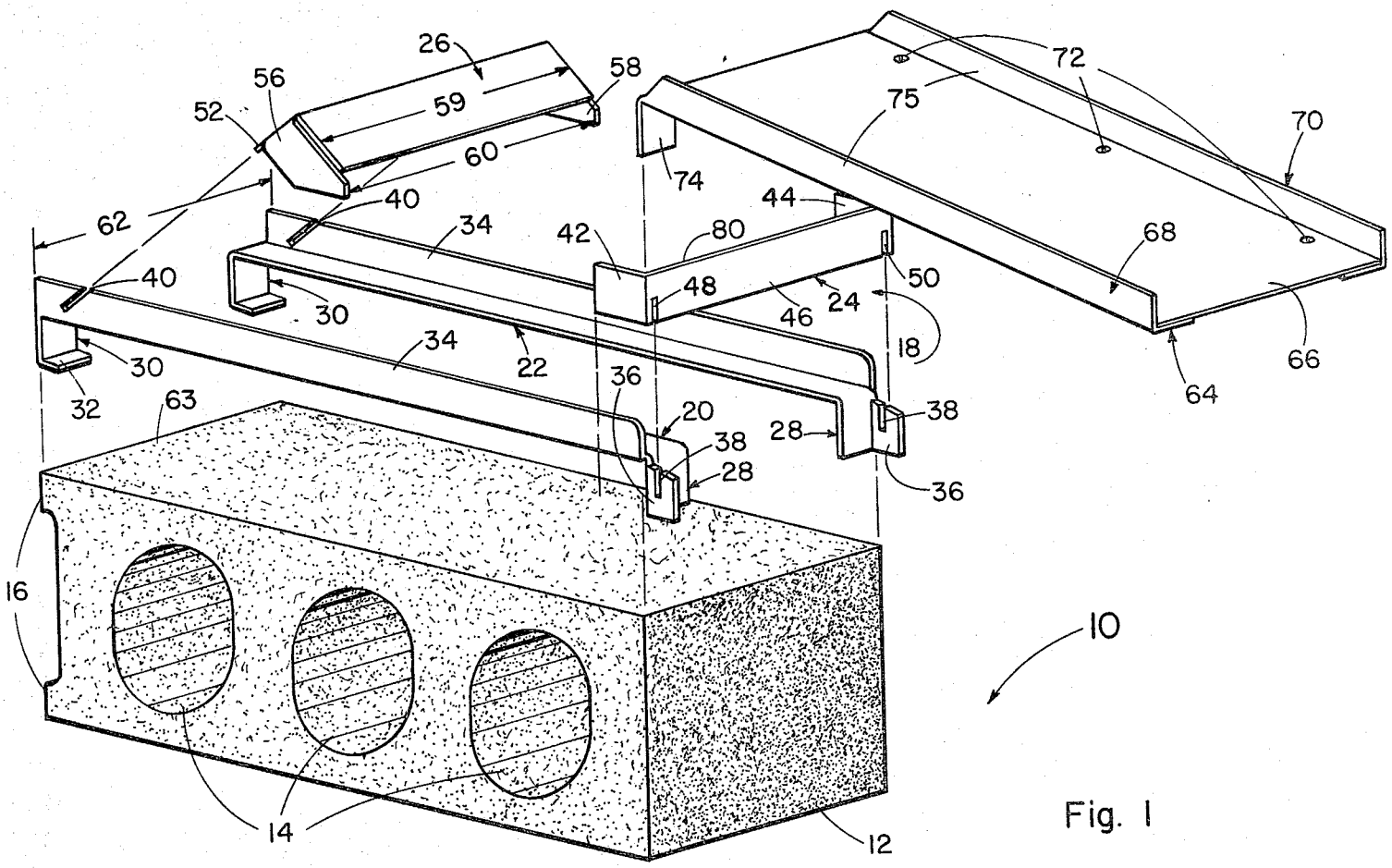
FIG. 1 is a prospective exploded view of the various elements of the invention.

Referring now to FIG. 1, there is shown an improved vehicle ramp and supporting device 10 in accordance with the principles of the invention.

The improved ramp and supporting device employs a cinder or concrete block 12. This is a standard block used extensively in the construction of homes, buildings and other structures. It is readily available at most retail home centers or building supply outlets. Typically, it measures $8'' \times 8'' \times 16''$ or $8'' \times 10'' \times 16''$. Its use as part of the improved car ramp requires that the block be laid on its side such that the longitudinal axis of openings 14 are parallel to the plane of the driveway, pavement, or other work surface. In this orientation, further, projections 16, which are typical for construction blocks, are disposed on the top and bottom sides of the block and extend parallel to the driveway.

Hereinafter the reference to direction, for example, "upward", "downward", "horizontal", "vertical", etc. presumes the ramp is disposed on a generally horizontal plane such as a driveway.

The improved device further comprises a frame 18. It includes left and right angle brackets 20 and 22; tie bracket 24; and, a chock bracket 26.

Angle brackets 20 and 22 are mirror images of each other. What is said hereinafter with respect to one, applies, likewise, to the other. Typically, they are fabricated from $1'' \times 1''$ angle brackets. Each bracket is modified to include a front and rear tab 28 and 30 which is at right angles to the longitudinal axis of the main portion of the bracket. Further, the rear tab 30 includes a portion 32 which is bent such that the tab 30 conforms to the configuration of projection 16. The distance between the tabs 28 and 30 is such as to conform to the longitudinal dimension. This results in a relatively snug fit between the bracket and the block.

Sidewall 34 of each angle bracket is cut and bent at one end to form tab 36. The latter is notched to form slot 38 which accepts the tie bracket 24. Near the other end of the brackets, there is formed an angled slot 40 into which is positioned the chock bracket 26.

Tie bracket 24 is made from bar stock. Ends 42 and 44 are formed by bending the stock at right angles to the main portion 46. The bends are made at a point where the distance between the insides of the ends 42 and 44 is close in dimension to the width of the block such that it can span the block. Cut into the bottom side of portion 46 are slots 48 and 50, which cooperate with the slots 38 in pieces 36 of the angle brackets to provide a means for locking the one end of the angle brackets together and registering the frame to the cinder block.

Figure 2:
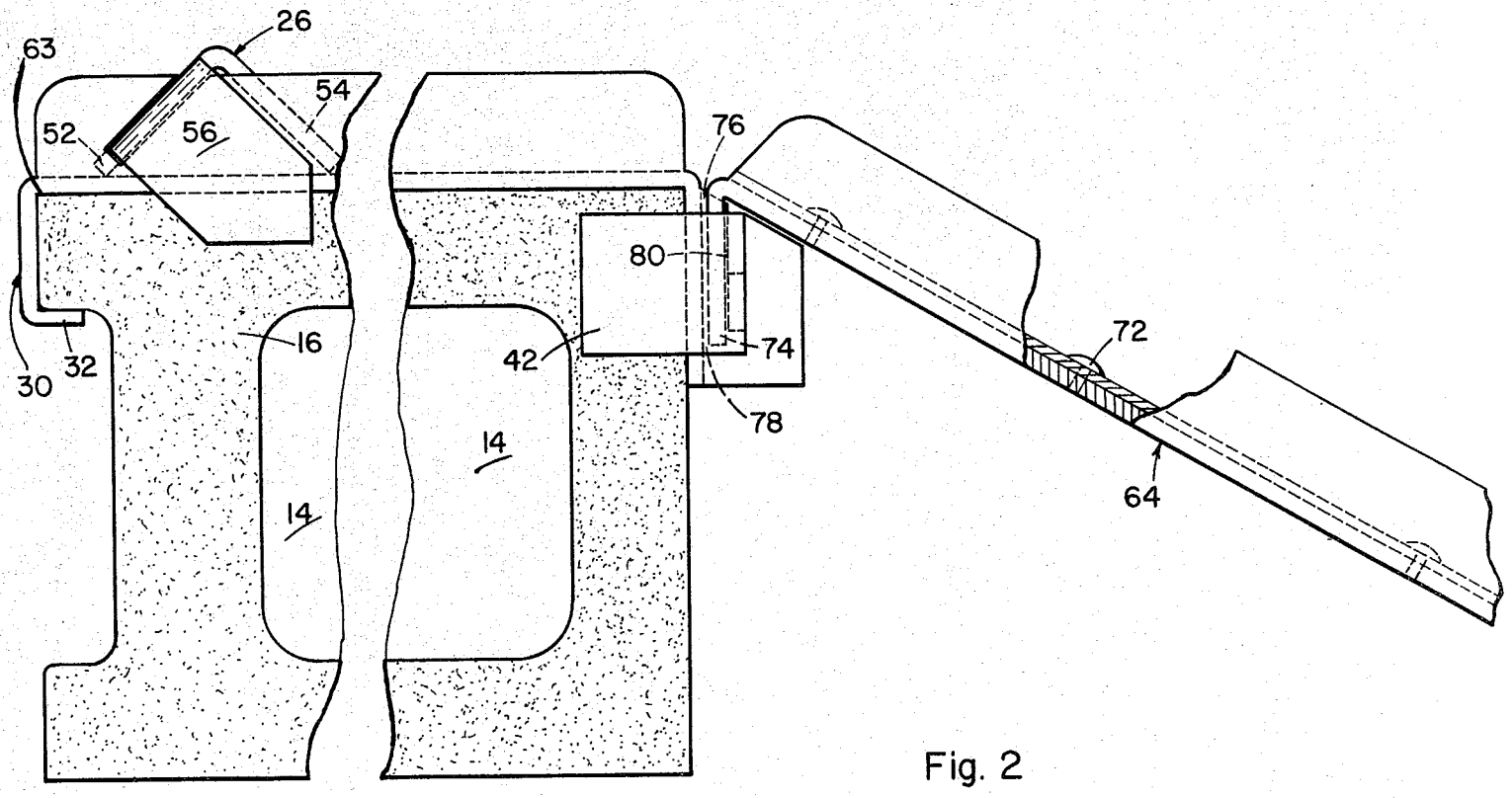
FIG. 2 is a partial elevational view of the invention.

Chock bracket 26 is formed from angle iron stock, for example 2"×2" stock. Refer to both FIGS. 1 and 2 during the following description. The bracket includes main segments 52 and 54. Tabs 56 and 58 are formed as follows: Segment 54 of the stock angle bracket is cut such that its length 59 is approximately equal to but less than the distance between the inboard surfaces of sidewalls 34 when the latter are properly positioned on the block 12. Segment 52 is cut such that its length, 1"×1" angle stock for brackets 20 and 22, is approximately 2½ longer than segment 54, at each end. The bends are made such that the distance, labeled 60 in the drawing, between the two tabs 56 and 58, is substantially equal to the distance 62 between the outboard surfaces of sidewall 34 for each bracket 20 and 22.

At assembly, chock bracket 26 is attached to the angle brackets 20 and 22. For the dimensions described, the bottom portion of tabs 55 and 58 are below the top surface of the cinder block 63 (see FIG. 2). This eliminates lateral movement of the assembled frame in relation to the cinder block at the chock end; while the tie bracket 24 when in place, prevents such movement at the ramp end of the block. Once the chock bracket is in place, it provides the necessary stop to prohibit the car tire from rolling off the block.

The invention further comprises a ramp 64. This includes a steel plate 66 which is secured to each of two angle brackets 68 and 70 (again 1"×1" have been found suitable) at various places 72 along the length thereof. In this situation, at the end to be mounted to the frame, encompassing the cinder block, one side of each of the brackets is bent downward and slightly back (see FIG. 2) to form tabs 74. The spacing between the tabs when the ramp is assembled, is such that the sidewalls 75 are aligned with their counterparts 34 of brackets 20 and 22. When assembling the ramp to the block frame, the dimensions of the various components are such that the tabs 74 fit into the space 76 formed between surface 78 of tab 28 and surface 80 of main portion 46 of bracket 24. This locks the ramp to the block from structure, providing a sturdy and motionless ramp for the car wheel. The ramp can be made in varying sizes, employing the same basic principles, to accommodate standard cinder block sizes. For example, where the cinder block is the 8"×8"×16" size, the ramp might be approximately 17" in length. This would be expanded to 21" in length for an 8"×10"×16" block, to allow for a gradual rise.

As noted above, the present invention provides an inexpensive, compact, safe car ramp and lifting device which is easy to assemble or disassemble and store for future use. It utilizes an inexpensive concrete block but yet provides the rigidity and safety associated with the more costly devices of unitary construction. The ease with which the frame and ramp can be assembled or disassembled, stored and carried enhance the devices' usefullness to the general public.

There are other variations to the present design as will be apparent after reading the above specification. It is understood obviously that the invention is not to be limited to the particular embodiment described but rather its breadth is to be measured by the scope of the appended claims.

What is claimed is:

1. An improved vehicle ramp and lifting device comprising:

(a) a construction block to form an improved vehicle ramp and lifting device, the construction block having first and second surfaces parallel to each other and extending in the direction of the longitudinal axis of the block from one end thereof, at, at least, said first surface; and (b) a framework including:

(i) first and second brackets, each having a first main portion and first and second tabs disposed at right angles to, and at opposite ends of, said main portion of the bracket, said main portion spanning the length of the block in the direction of its longitudinal axis, said first and second tabs configured to conform to the contour of the block at a respective end thereof, whereby said first and second brackets are restrained in movement relative to the block, in the direction of the longitudinal axis;

(ii) a first tie bracket including a second main portion and first and second ends formed at right angles to said second main portion, the distance between said first and second ends being substantially equal to the width of said block, said first and second brackets and said tie bracket, including cooperating means for connecting said tie bracket to one end of each of said first and second brackets, said first and second ends of said tie bracket coacting with the sides of the block to restrain movement of said first and second brackets relative to the block in a direction perpendicular to the longitudinal axis;

(iii) a second tie bracket, said first and second brackets and said second tie bracket, including cooperating means for connecting said second tie bracket to the remaining end of said first and second brackets, said second tie bracket is connected to said first and second brackets, to restrain movement of the remaining end of said first and second brackets relative to the block in a direction perpendicular to the longitudinal axis; and (iv) a ramp including means for removably connecting one end of said ramp to the end of the first and second brackets connected by said first tie bracket;

said main portion of said first and second brackets disposed upon the first surface of the block.

2. The framework claimed in claim 1 wherein said first and second brackets are formed from angle brackets and wherein said ramp includes two angle brackets and a plate connected therebetween.

3. The framework claimed in claim 1 wherein said second tie bracket includes a portion which acts as a chock to prevent the vehicle's wheels from going off that end of the block.

* * * * *